US007363991B2

(12) United States Patent
Baer

(10) Patent No.: US 7,363,991 B2
(45) Date of Patent: Apr. 29, 2008

(54) SYSTEM AND METHOD FOR RELOCATING EXTENDED LENGTH OBJECTS

(76) Inventor: Richard Dean Baer, 1003 Runyan, Artesia, NM (US) 86210

( * ) Notice: Subject to any disclaimer, the term of this patent is extended or adjusted under 35 U.S.C. 154(b) by 278 days.

(21) Appl. No.: 11/169,999

(22) Filed: Jun. 28, 2005

(65) Prior Publication Data

US 2006/0081400 A1 Apr. 20, 2006

Related U.S. Application Data

(60) Provisional application No. 60/619,292, filed on Oct. 18, 2004.

(51) Int. Cl.
*E21B 19/15* (2006.01)

(52) U.S. Cl. ..... 175/85; 414/22.54

(58) Field of Classification Search ..... 175/52, 175/85; 166/77.1, 85.1; 414/22.52, 22.54, 414/22.58, 22.62

See application file for complete search history.

(56) References Cited

U.S. PATENT DOCUMENTS

| | | | | |
|---|---|---|---|---|
| RE24,907 | E * | 12/1960 | Maydew | 414/22.59 |
| 3,268,095 | A * | 8/1966 | Durbin | 414/22.59 |
| 3,655,071 | A * | 4/1972 | Langowski et al. | 414/22.58 |
| 4,832,552 | A * | 5/1989 | Skelly | 414/22.54 |
| 6,994,505 | B2 * | 2/2006 | Hawkins, III | 414/22.54 |
| 7,090,035 | B2 * | 8/2006 | Lesko | 175/57 |

* cited by examiner

*Primary Examiner*—Kenneth Thompson

(57) ABSTRACT

A system and method for lifting and translating extended length objects includes a power roller assembly attached to an extendable mast. When a roller on the power roller assembly contacts the outer surface of the extended length object, extension or retraction of the extendable mast enables lifting or lowering of the end of the extended length object. Rotation of the roller on the power roller assembly translates the position of the extended length object in a direction parallel to the long axis of the extended length object.

34 Claims, 13 Drawing Sheets

SYSTEM AND METHOD FOR RELOCATING EXTENDED LENGTH OBJECTS

This application claims priority from Provisional U.S. Patent Application No. 60/619,292 filed Oct. 18, 2004.

FIELD

The system and method of the present invention relates to equipment for the movement and positioning of extended length objects, such as sections of pipe; more particularly, the present invention relates to a system for elevating one end of an extended length object and translating the position of the extended length object along a line parallel to the long axis of the extended length object.

BACKGROUND

While the present invention has been developed and is described in terms of its use in the oilfield, those of ordinary skill in the art will understand that the disclosed system and method may be used in a variety of applications where extended length objects must be relocated from one position to another.

Those with experience in the oilfield are familiar with those wells into which long sections of pipe are screwed together and inserted into the well as a long pipe string. Typically, workers on a rig floor positioned over a well bore perform the task of receiving a section of pipe from a temporary storage location near the well, elevating the section of pipe to a substantially vertical position, and then threadably connecting the elevational section of pipe to another section of pipe which has been partially inserted into the well bore. The threadably joined sections of pipe eventually form a continuous pipe string which extends from above the earth's surface to the bottom portion of the well.

The derrick or large structure which provides a signature appearance to an oil rig positioned over a well bore facilitates the lifting of an extended length section of pipe to a substantially vertical position. Once in a vertical position, the extended length section of pipe is threadably connected to another section of pipe lower in the pipe string.

When a pipe string is pulled out of the well bore to either service or close down a well the process described above is effectively reversed. Specifically, as each section of pipe is pulled from the well bore, it must be first threadably disconnected from the next lower section of pipe in the pipe string before being moved out the way and placed in storage while the next lower section of pipe is extracted from the well bore.

For many years the activity of moving sections of pipe between a storage location near the well to a location over the well bore was an operation that well hands performed manually. Because of the weight of the sections of pipe and the speed of the activity on a rig floor, well hands often become fatigued or injured. In other situations, well hands have either lost control of or dropped a section of pipe, causing either damage to valuable equipment or injuries to other workers.

A further description of the problems and dangers associated with manually moving sections of pipe near an oil rig may be found in U.S. Pat. No. 4,386,883 and U.S. Pat. No. 6,079,925.

Both U.S. Pat. No. 4,386,883 and U.S. Pat. No. 6,079,925 describe the use of a large machine which operates by mounting a section of pipe in a long trough. In both patents the long trough is positionable by being mounted to a frame whose vertical height, at one end, is controllable. Movement of the section of pipe along the long trough is accomplished by use of a pusher. The pusher provides a force on the lower end of the section of pipe to cause the section of pipe to slide along the long trough far enough to place the upper end of the section of pipe in a desired location. Because the long trough is nearly as long as the section of pipe, the frame which supports the long trough is also nearly as long as the sections of pipe. For large wells, this length can be as much as 50 feet.

Those with experience in the oilfield know that sections of pipe are often transported on long semi-trailers to the site of an oil rig. The transport of the devices described in U.S. Pat. No. 4,386,883 and U.S. Pat. No. 6,079,925 to an oil rig also requires use of a long trailer. Then, once at the site of an oil rig, a major effort is required to first unload and then position the devices described in U.S. Pat. No. 4,386,883 and U.S. Pat. No. 6,079,925 into a location near both the rig floor and the area in which the sections of pipe destined for insertion into the well bore are temporarily stored. When the movement of sections of pipe has been completed another major effort is required to move the devices away from the rig floor and onto a long trailer for use at the site of another oil rig. The effort to move the devices described in U.S. Pat. No. 4,386,883 and U.S. Pat. No. 6,079,925 is both time-consuming and expensive.

Accordingly, a need remains in the art for a system and method which can quickly, easily and inexpensively be put in position to move extended length objects, such as sections of pipe, into locations where they can be further handled or put in place for their desired purpose.

SUMMARY

The present invention describes a system and method for quickly, easily, and inexpensively moving extended length objects, such as sections of pipe, into locations where the extended length objects can be further handled or put in place for their desired purpose. The devices which perform this function have been referred to by some as "pick-up and lay-down" equipment.

The system and method of the present invention for lifting or lowering one end of a substantially horizontally oriented and extended length section of pipe and then moving the section of pipe in a direction parallel to its long axis is built around a power-driven roller assembly. The power-driven roller assembly is mounted on a carrier. A base and a mast assembly are used to position the carrier in locations on an x-axis, a y-axis, and a z-axis with respect to the base.

Included in the mast assembly are a mast and a base. When a power-driven roller in the power-driven roller assembly contacts the outer surface of a section of pipe at one end of the section of pipe, movement of the mast lifts or lowers the end of the section of pipe and the turning motion of the power-driven roller is able to translate the pipe in a direction parallel to the long axis of the section of pipe.

When the device of the present invention is mounted to a catwalk on which sections of pipe are located, the present invention enables automatic lifting or lowering while simultaneously translating the section of pipe to a location from the catwalk on which the section of pipe is located to another location where the section of pipe may be grabbed and positioned for another operation. For example, in the creation of string of pipe sections to be lowered into a well bore, the device of the present invention moves individual sections of pipe from a catwalk near the rig floor to a position where an individual section of pipe can be grabbed by an elevator and hoisted into a vertical position for joining with another section of pipe which has already been partially inserted into a well bore. Alternatively, in the disassembly of a pipe string the device of the present invention enables repositioning of the sections of pipe as they are pulled from the well and disassembled from the pipe sections remaining in the well back onto a catwalk or some other type of storage device.

BRIEF DESCRIPTION OF THE DRAWING FIGURES

A better understanding the system and method for lifting and translating extended length objects of the present invention may be had by reference to the drawing figures wherein.

DESCRIPTION OF THE EMBODIMENTS

The present invention is described in terms of its use in the oilfield to move extended length sections of pipe; however, those of ordinary skill in the art will realize that the disclosed invention may be used to relocate extended length objects from a substantially horizontal storage position to another position where the extended length object is relocated to another position where the orientation of the extended length object may be oriented at a substantially acute angle.

Figure 1A:
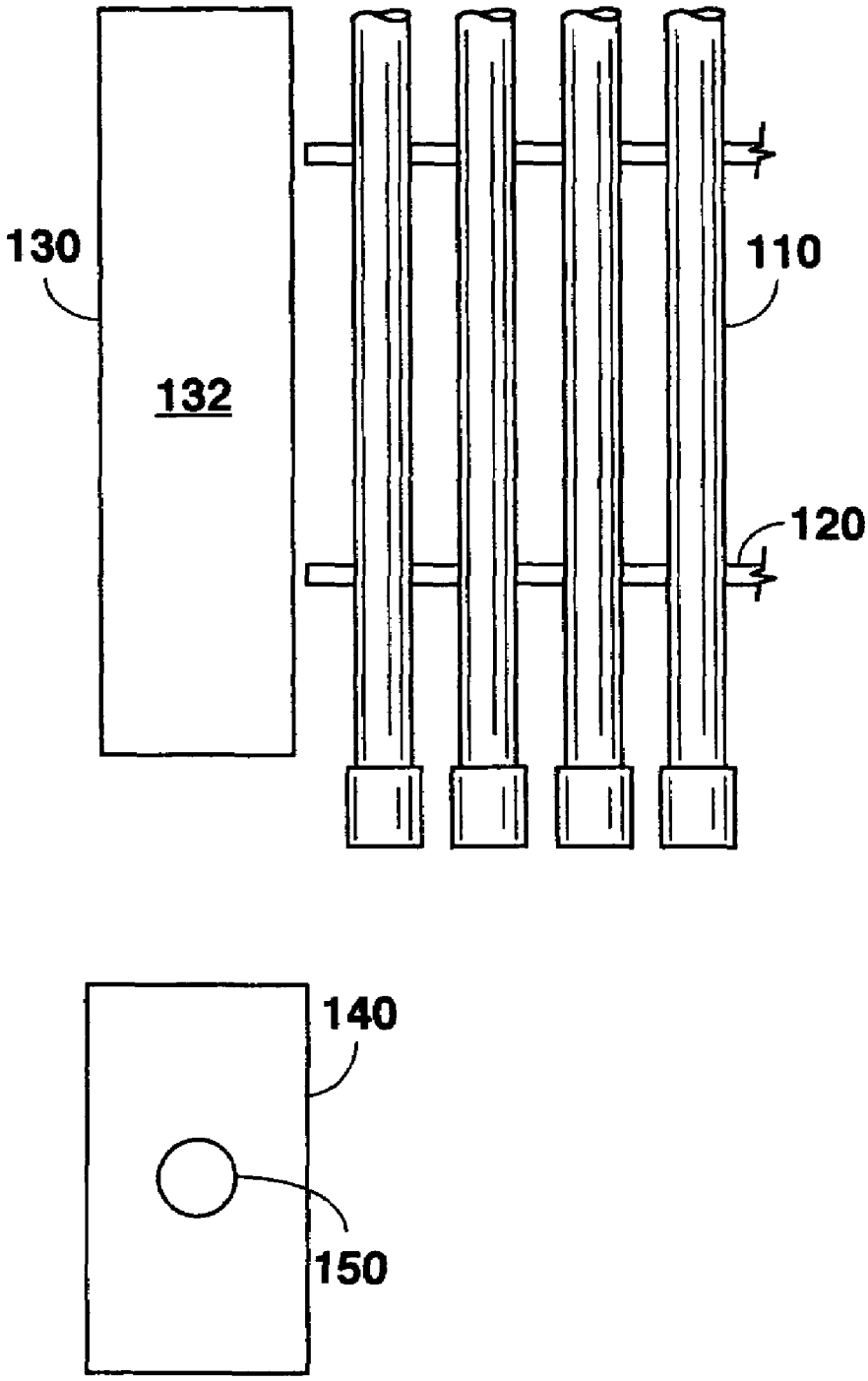
FIG. 1A (Prior Art)
FIG. 1A is a plan view of the typical layout of equipment at the site of an oil rig.
Figure 1B:
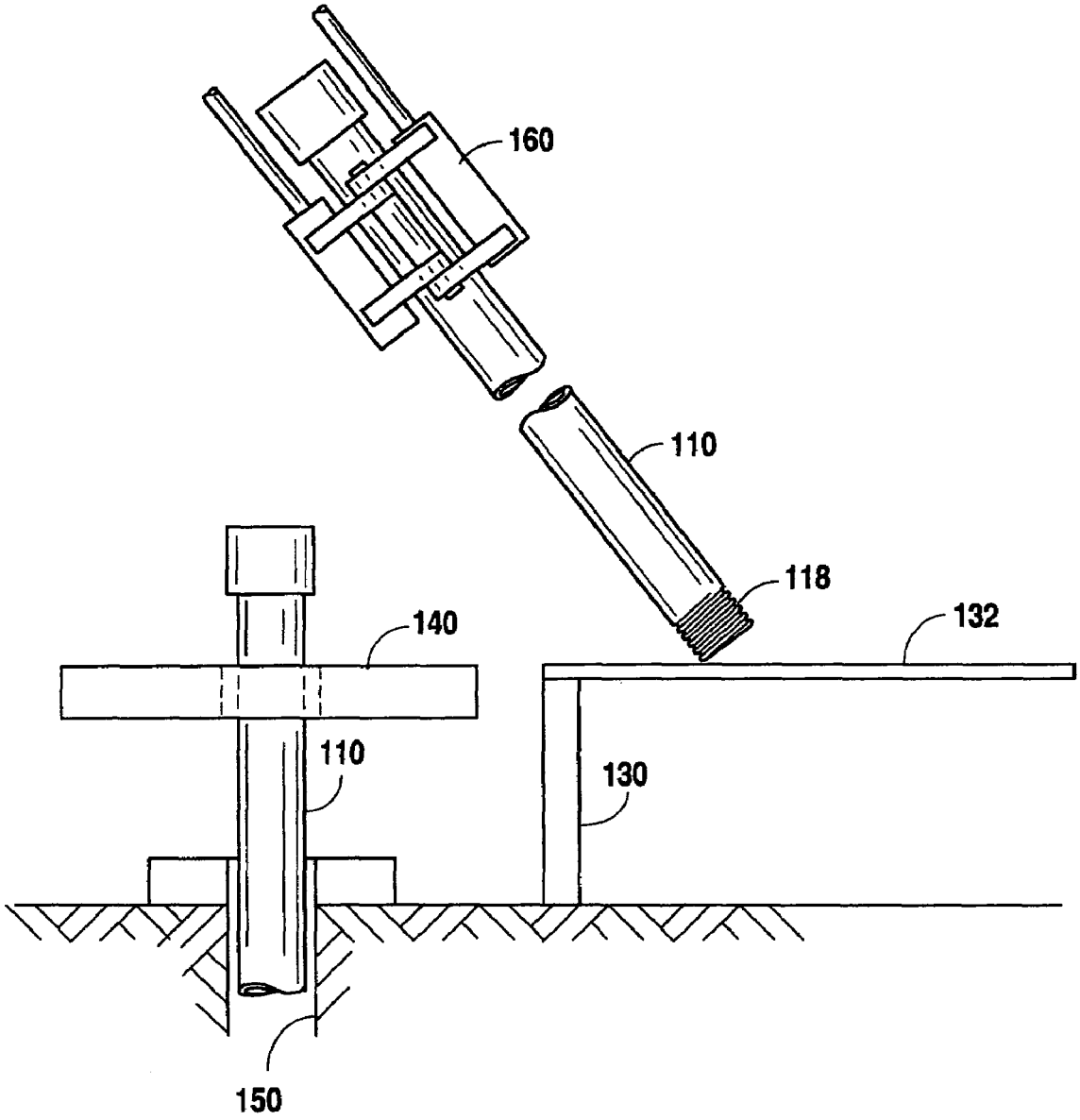
FIG. 1B (Prior Art)
FIG. 1B is an elevational view of a section of pipe being moved from a catwalk.
Figure 1C:
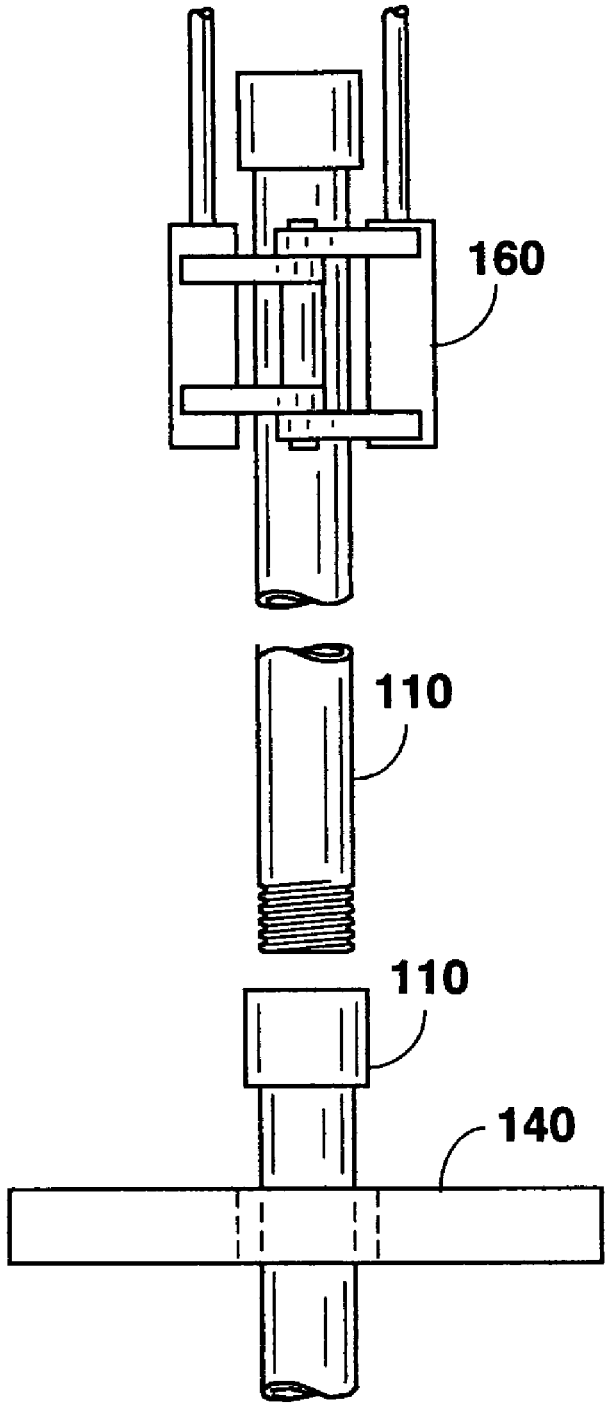
FIG. 1C (Prior Art)
FIG. 1C is an elevational view of a section of pipe positioned over a well bore ready for connection to another section of pipe.

In FIGS. 1A, 1B, and 1C, a typical configuration of the equipment close to an oil rig is shown. Not shown is the derrick which extends upwardly from a rig floor 140 which surrounds and is positioned over the well bore 150. The derrick is used to hoist sections of pipe 110 into a vertical position over the well bore 150 so that multiple sections of pipe 110 may be threadably connected, one to another, for insertion into the well bore 150. Such sections of pipe 110 may be anywhere from about 30 feet to about 50 feet in length. The diameter of the sections of pipe 110 may be as small about 2 inches to as large as about 5 inches. Longer sections of larger diameter pipe 110 are quite heavy and accordingly quite difficult to move.

Movement of the sections of pipe 110 used in a well is usually from one or more temporary storage racks 120 positioned near the well to a catwalk 130 on which the sections of pipe 110 remain on a substantially horizontal elevated platform 132 until they are needed over the rig floor 140 for insertion into the well bore 150. In some oil rig operations, well hands actually lift the sections of pipe 110 and then carry each section of pipe 110 closer to the rig floor 140 so that each section of pipe 110 may be grabbed by a pipe elevator 160 and hoisted into a substantially vertical position over the well bore 150.

When the sections of pipe 110 are removed from a well bore 150 they are pulled out of the well bore 150 in a substantially vertical manner. The next step is to move the sections of pipe 110 back onto the catwalk 130 or directly onto a pipe storage rack 120. Once again, in some oil rig operations, well hands are often used to both manually support and then guide each section of pipe 110 as it moves from above the rig floor 140 back to the catwalk 130 or onto a pipe storage rack 120.

The system and method of the present invention 10 may be understood by reference to FIGS. 2A, 2B, 2C, and 2D, which illustrate the movement of a section of pipe 110 using the preferred embodiment of the disclosed invention. Therein, it may be seen that a mast assembly 20 is attached to the end of the catwalk 130. A carrier 42 for a power-driven roller assembly 40 is attached to the mast portion 26 of the mast assembly 20. Thus, when the carrier 42 for the power-driven roller assembly 40 is moved along with the outer portion 22 of the substantially vertical extendable mast assembly 20, the surface 44 of the power-driven roller 46 comes into contact with the exterior surface 112 of the section of pipe 110 at that end 114 of the section of pipe 110 which extends past the end of the catwalk 130. The contact between the surface 44 of the power-driven roller 46 and the exterior surface 112 of the half 115 of the section of pipe 110 nearest the oil rig causes the power-driven roller 46 to bear a portion of the weight of the section of pipe 110 and lift that end 114 of the section of pipe 110 from the top 132 of the catwalk 130. As long as the half 115 of the section of pipe 110 nearest the oil rig remains on the power-driven roller 46, the end 116 of the section of pipe 110 which remains on the top 132 of the catwalk 130 transfers the remaining portion of the weight of the pipe 110 onto the catwalk 130.

When the power-driven roller 46 is turned, the friction between the exterior surface 112 of the section of pipe 110 and the surface 44 of the power-driven roller 46 causes the section of pipe 110 to move or translate along a line which is parallel to the long axis of the section of pipe 110. That end 116 of the section of pipe 110 which remains on the catwalk 130 slides along the top surface 132 of the catwalk 130 as the section of pipe 110 is moved into an increasingly larger acute angle with respect to the top 132 of the catwalk 130 as the section of pipe 110 is moved closer to the rig floor 140. Protection of the threads 118 at the end 116 of the section of pipe 110 which remains in contact with the top 132 of the catwalk 130 is provided by a small plastic or rubber cap (not shown) which is easily removable when direct access to the threads 118 is needed. For exceptionally large and heavy sections of pipe 110 it may be necessary to place a small roller (not shown) under the end 116 of the section of pipe 110 which remains on the top 132 of the catwalk 130.

Figure 3:
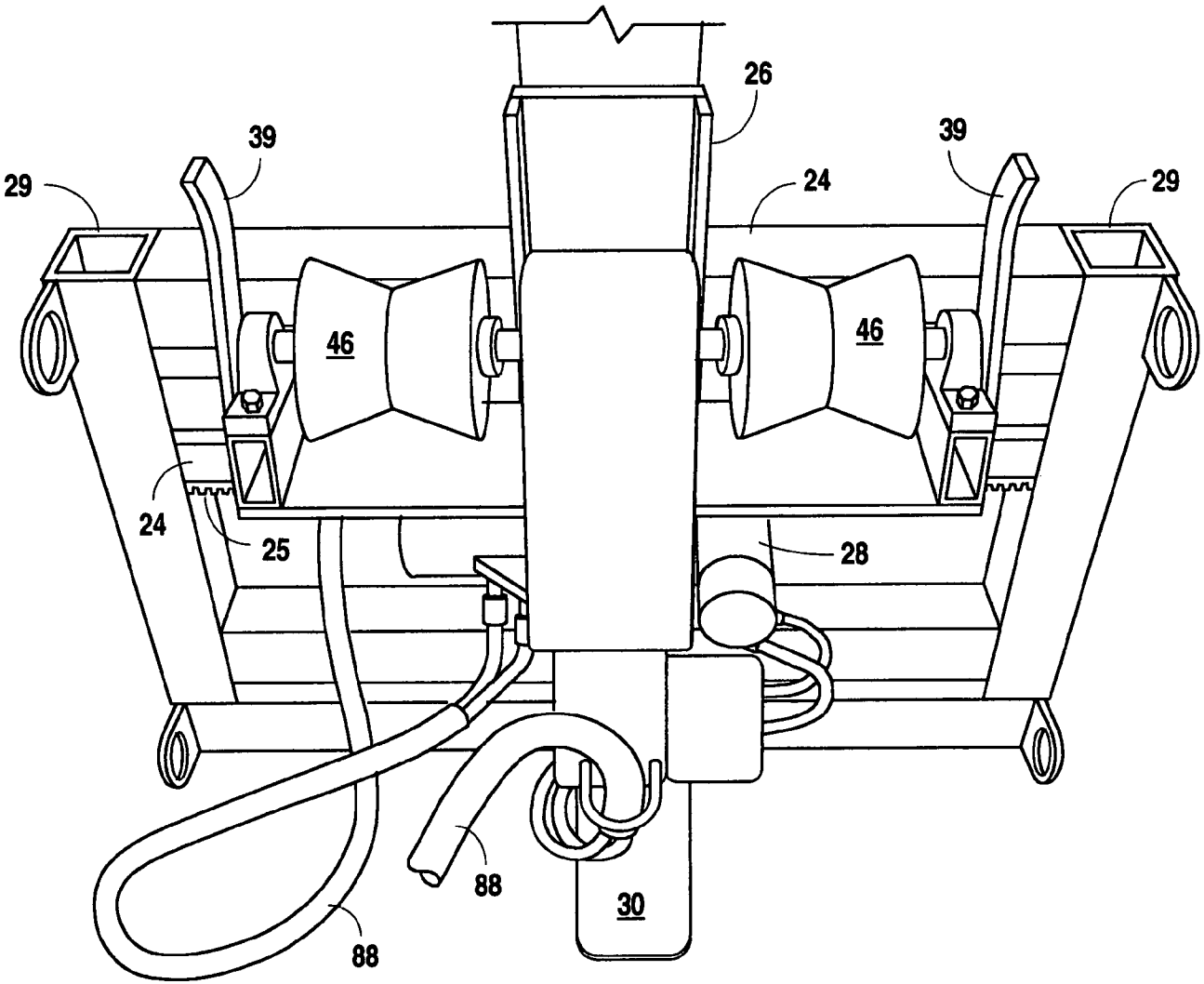
FIG. 3 is a front perspective view of the base portion of the extendable mast assembly.
Figure 4:
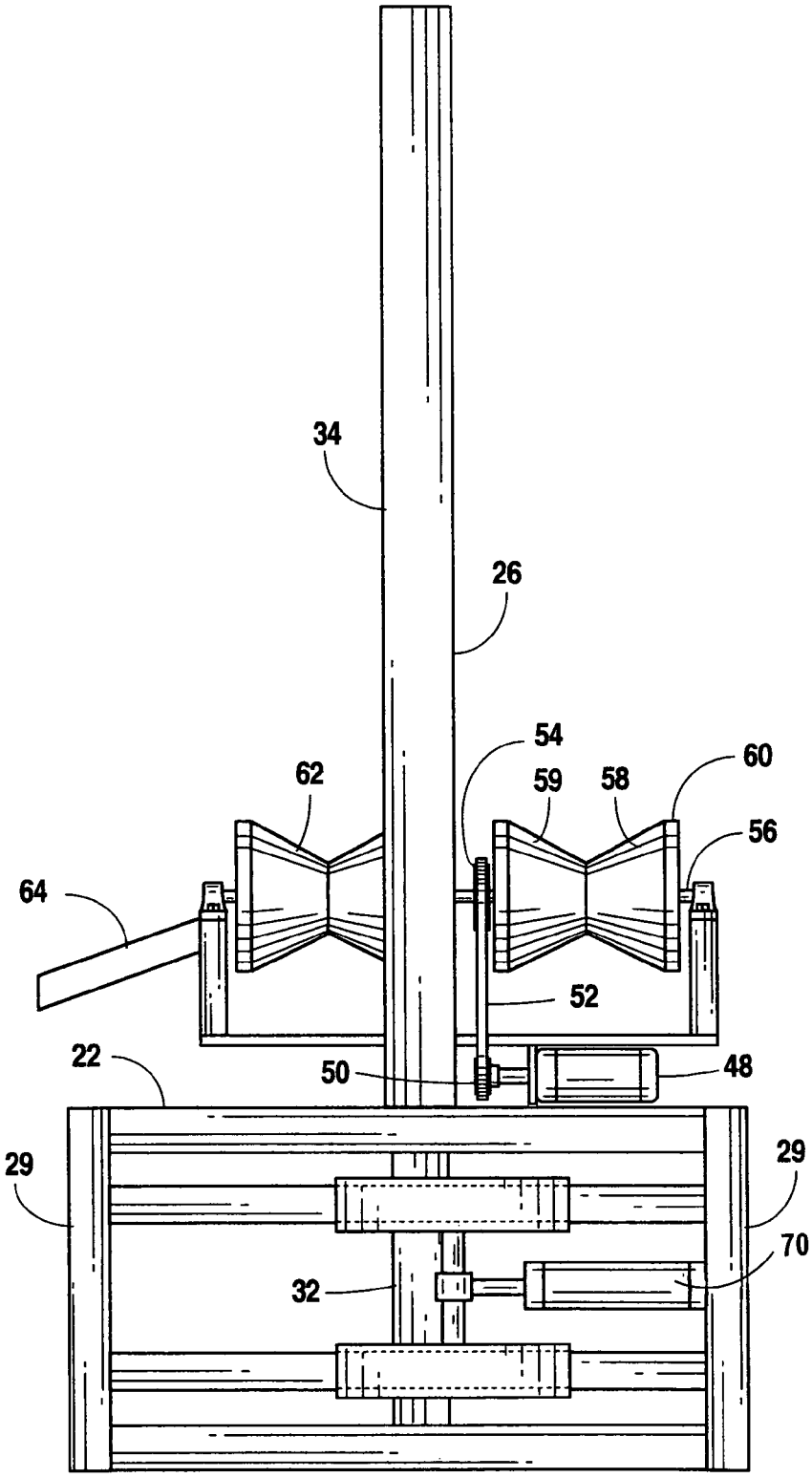
FIG. 4 is a rear elevational view of the lifting and translating system.
Figure 5:
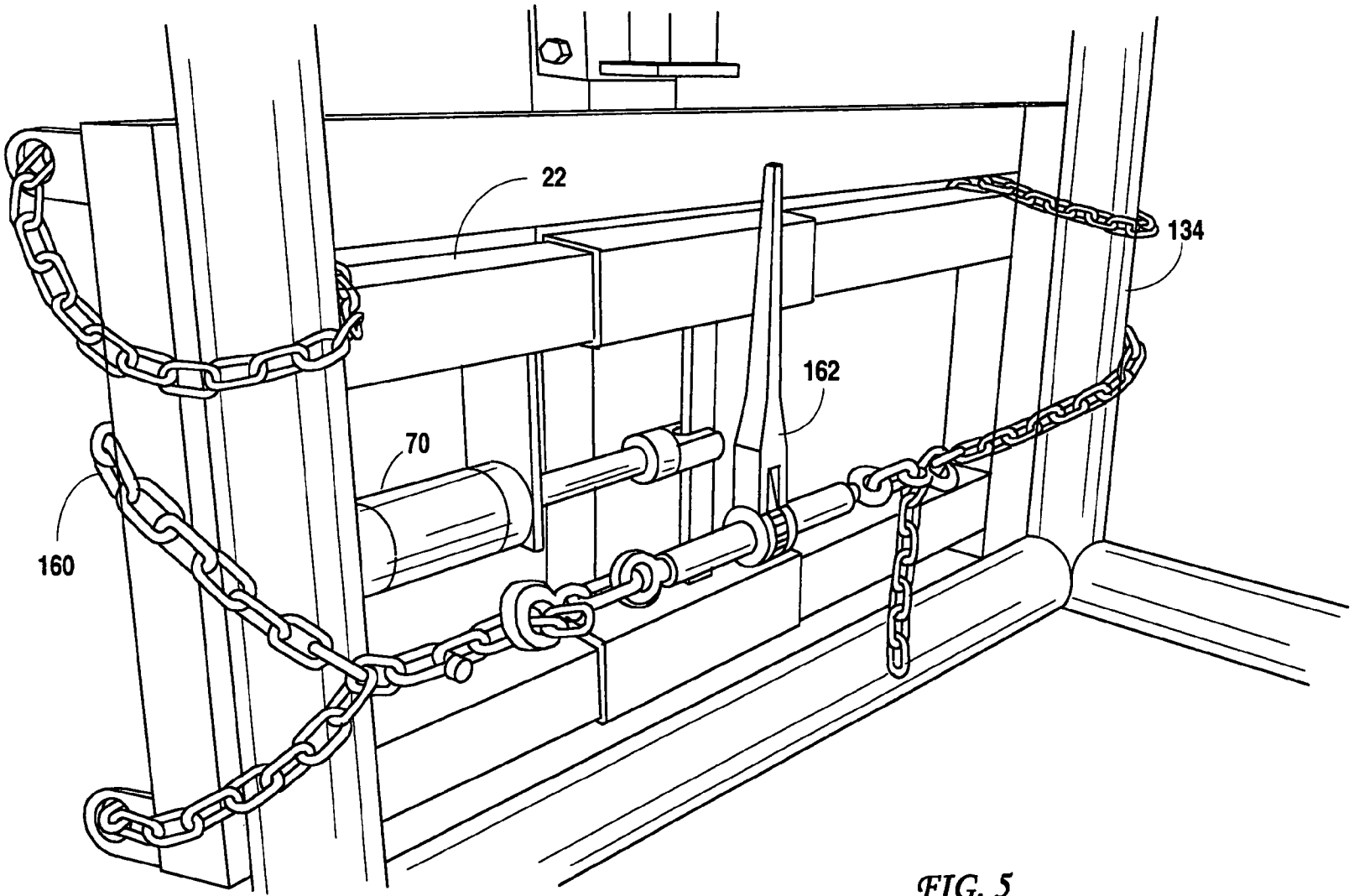
FIG. 5 is a rear perspective view of the base portion of the extendable mast assembly attached to the end of a catwalk by chains.

A description of the construction of the lifting and translating portion 12 of the system of the present invention 10 begins with a description of the mast assembly 20. Specifically, the mast assembly 20 includes a base portion 22 as shown in FIG. 3 and FIG. 4. In the preferred embodiment, the base portion 22 is chained to that end of the catwalk 130 nearest the rig floor 140, as shown in FIG. 5. In other situations the hollow legs 29 on either side of the base portion 22 may be slid over and attached to poles located in the ground for positioning the base portion 22 and holding it in position. In yet other situations, the base portion 22 may be attached to the oil rig. In still other situations, a stand-alone base portion 22 may be used provided that the base portion is of sufficient size and weight to bear the weight of the section of pipe 110 and to not tip over when the pipe section 110 is being moved along a path parallel to its long axis by the drive roller 46. Those of ordinary skill in the art will understand that a wide variety of different constructions are suitable for the base portion 22.

As shown in FIG. 3, included in the base portion 22 of the mast assembly 20 is a rack-and-pinion gear assembly 24. This rack-and-pinion gear assembly 24 enables shifting the carrier 42 for the power-driven roller assembly 40 from side to side to gain better access to a section of pipe 110 or to move a section of pipe 110 into a position closer to where it needs to be. Also included in the base portion 22 is a hydraulic motor 28 which turns the pinion. Thus when the pinion gear is turned, the contact between the teeth on the pinion portion of the rack-and-pinion gear assembly 24 and the teeth 25 on the rack portion of the rack-and-pinion gear assembly 24 causes the carrier 42 to move back and forth or left and right along a substantially horizontal path or x-axis. When the carrier 42 has been properly positioned on the x-axis, it is the mast 26 which forms a y-axis, perpendicular to the x-axis for moving the carrier 42 into a higher position above the base portion 22.

Alternatively, a hydraulic cylinder 70, as shown in FIGS. 4 and 5, may be used to move the mast 26 from side to side.

If desired, the base portion 22 may also include a small foot 30 which extends outwardly from the bottom of the base portion 22 to prevent the base portion 22 from falling over while it is being chained to the end 134 of the catwalk 130. The base portion 22 is constructed from sections of structural tubing which are sized to bear the weight of the largest object with which the device of the present invention 10 is expected to be used.

Optionally, guard bars 39 may be used alongside the powered rollers 46.

In the preferred embodiment, the substantially vertical mast 26 is constructed in two parts. The bottom part of the mast 26 is affixed to the base portion 22. The top part 34 of the mast 26 is sized to surround or telescope over the bottom part 32 of the mast 26. Placed either within the mast 26 or alongside the mast 26 is a hydraulic cylinder or ram 36 which connects the bottom part 32 of the mast 26 to the top part 34 of the mast 26. When the hydraulic cylinder or ram 36 is caused to extend, the top part 34 of the mast 26 moves upwardly with respect to the bottom part 32 of the mast 26. To guide the travel of the top part 34 of the mast 26 with respect to the bottom part 32 of the mast 26, a plurality of guide pads 33, such as those made from a low friction material, e.g., Teflon®, may be used. When the hydraulic cylinder or ram 36 is caused to retract, the top part 34 of the mast 26 moves downwardly with respect to the bottom part 32 of the mast 26.

While a telescoping mast 26 is used in the preferred embodiment, those of ordinary skill in the art will understand that a variety of different mechanisms may be used to raise and lower the carrier 42 up and down along the y-axis. Such other embodiments may include a chain drive or rack-and-pinion assembly.

At the top of the top part 34 of the mast 26 is a cap 38 to protect the top part of the mast 26 in the event that a loose section of pipe 110 falls near the lifting and translating portion 12 of the present invention 10.

The carrier 42 for the power-driven roller assembly 40 is affixed to the top part 34 of the mast 26. This carrier 42 includes a hydraulic motor 48 which turns a first sprocket 50, The first sprocket 50 moves a chain 52 which in turns a second sprocket 54. The second sprocket 54 is attached to a shaft 56 on which a roller 46 is located. The shaft 56 is positioned to be substantially perpendicular to the top part 34 of the mast 26. Those of ordinary skill in the art will understand that the roller 46 may be mechanically connected to a wide variety of different sources of rotational power including air motors or electrical motor which can be mounted to the carrier 42.

The surface 44 of the power-driven roller 46 is preferably shaped to have a V-shaped notch 58 which enables the roller 46 to be used with sections of pipe 110 having a wide range of diameters as long as the outer surface 112 of the section of pipe 110 is in contact with the interior sides 59 of the V-shaped notch 58.

The surface 44 of the roller 46 has a coating 60 which exhibits a high coefficient of rolling friction with respect to the surface with which it is in contact; which, in the instant application, is the outer surface 112 of a section of pipe 110. In the preferred embodiment, a polyurethane having a durometer from about 45 to a durometer of about 90 or the use of sand or dirt has provided satisfactory results as a surface coating 60. In an alternate embodiment, a second power-driven roller 62 similar to roller 46 may be used to accommodate sections of pipe 110 located on either side of the substantially vertical extendable mast 26.

Those of ordinary skill in the art will understand that a variety of other coatings and other notch geometries may be used on the power-driven roller 46 provided that these coatings and notch geometries exhibit a sufficient coefficient of rolling friction to impart an adequate force, through frictional contact to enable translation of the section of pipe 110 in a direction parallel to its long axis throughout the range of acute angular orientations in which the section of pipe 110 may be positioned.

Figure 2A:
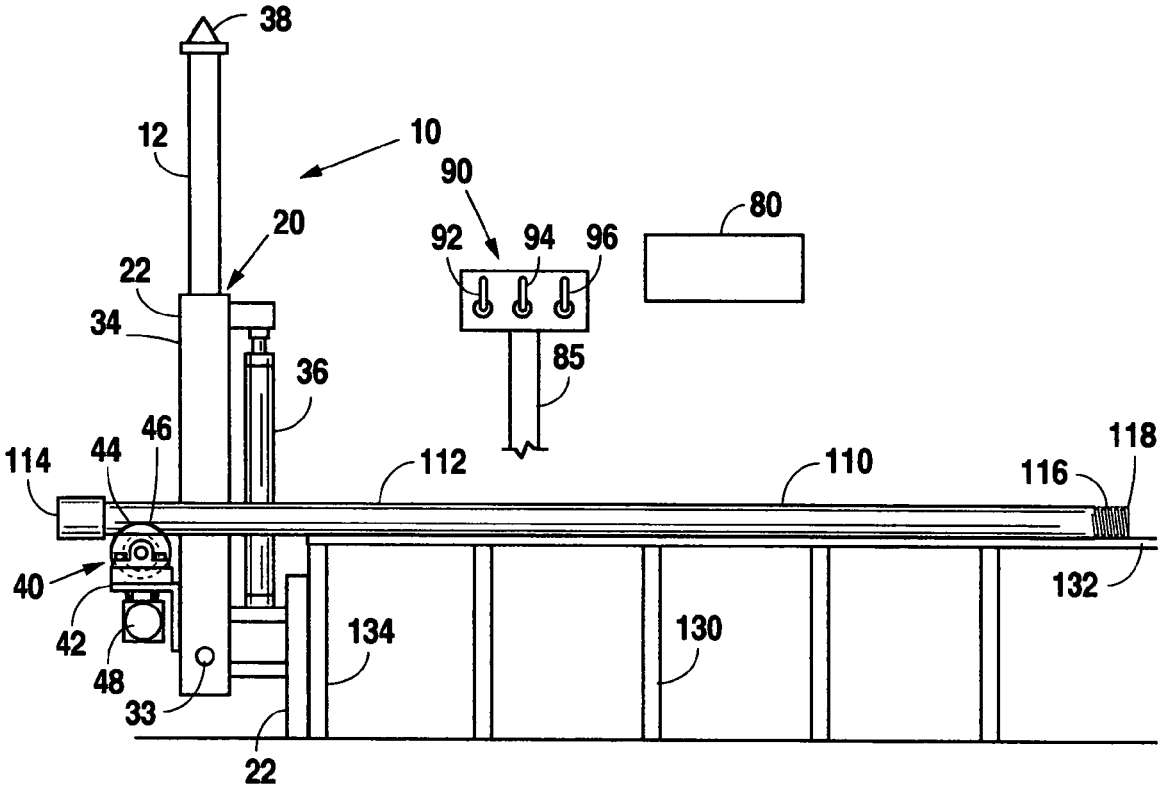
FIG. 2A is an elevational view of the lifting and translating system of the present invention attached to the end of a catwalk.
Figure 2B:
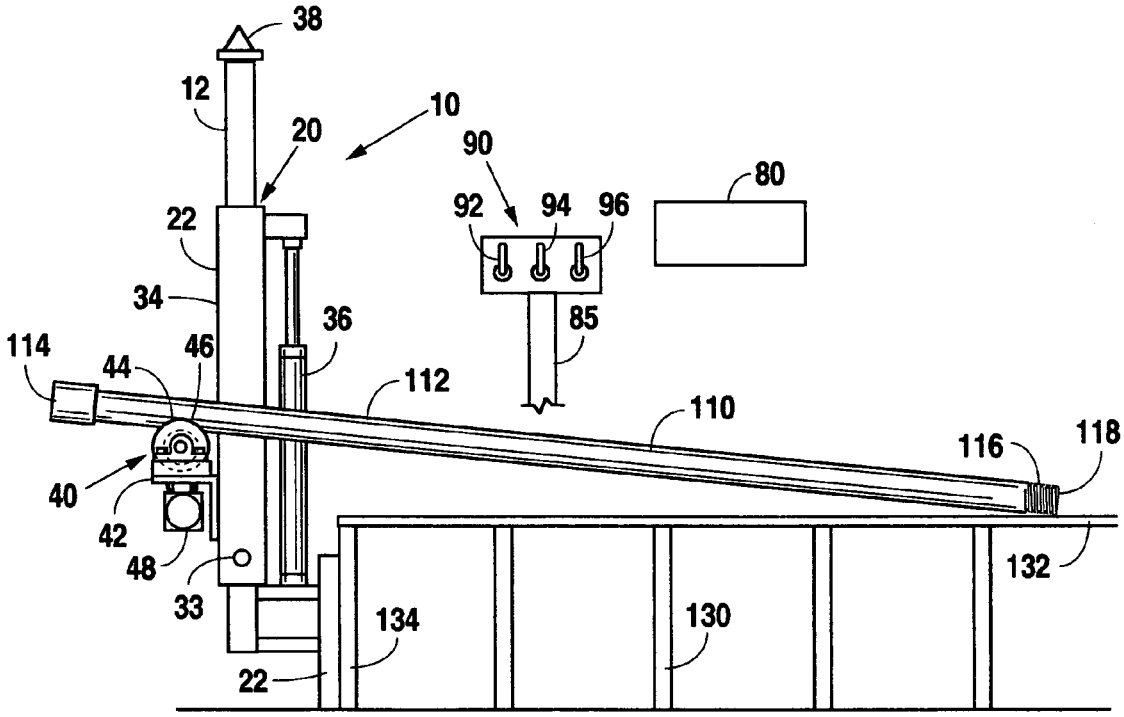
FIG. 2B is an elevational view of the lifting and translating system raising one end of a section of pipe.
Figure 2C:
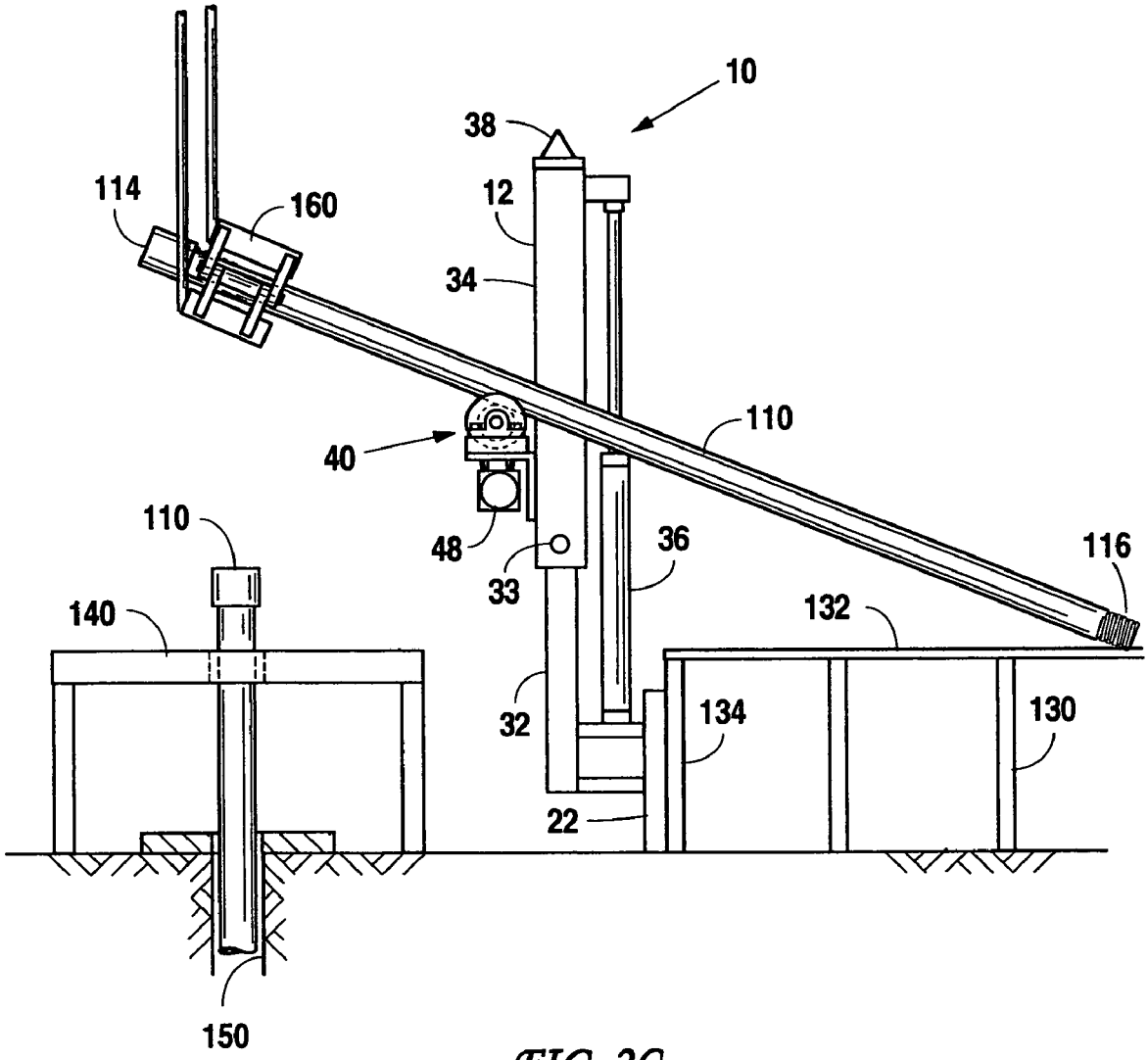
FIG. 2C is an elevational view of the lifting and translating system after having translated the section of pipe to where it can be grabbed for movement into a vertical position.
Figure 2D:
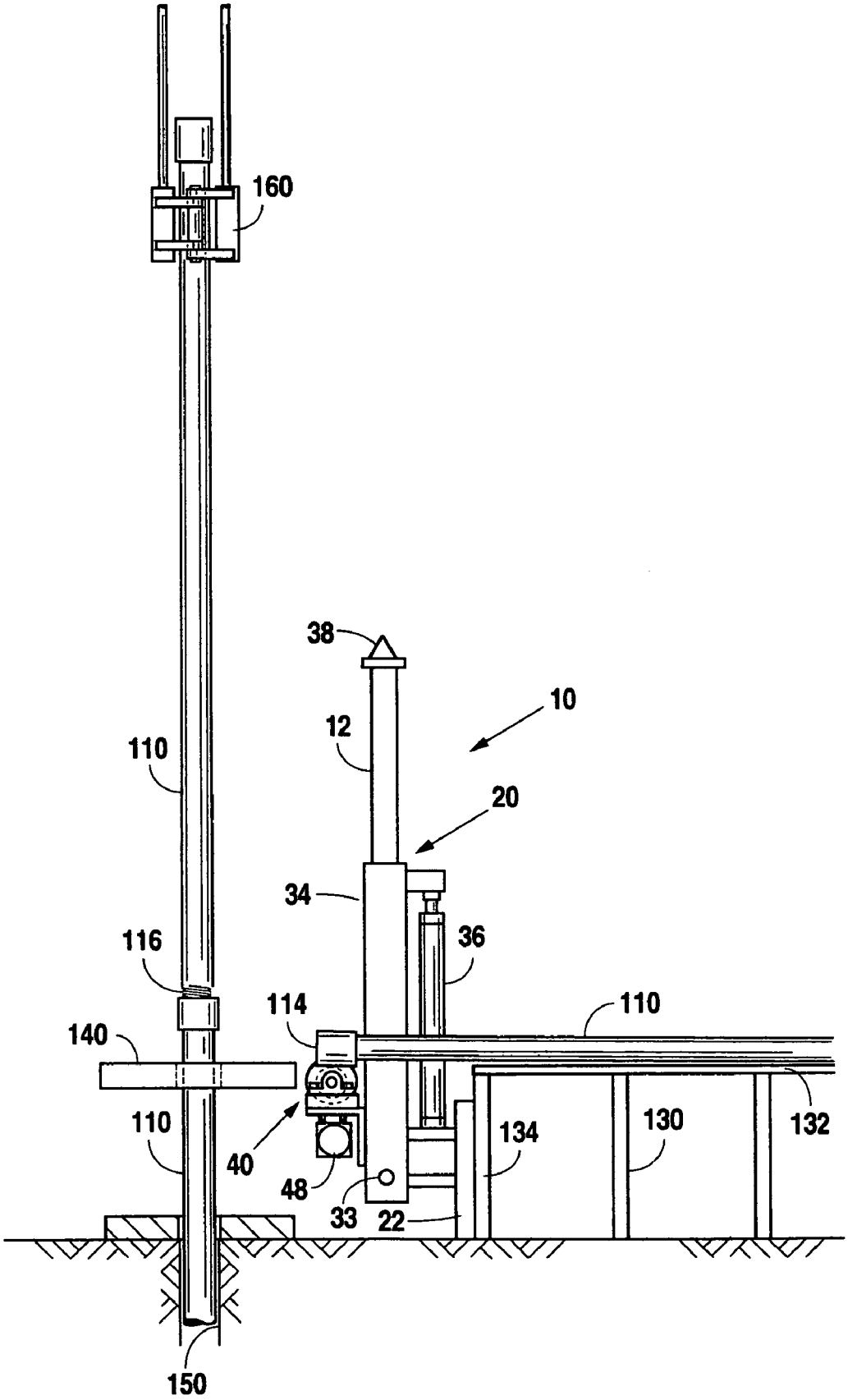
FIG. 2D is an elevational view of the lifting and translating system in readiness to move another section of pipe while the previous section of pipe is made ready for connection to the top of the pipe string extending from the well bore.

A drive motor 48 is used to turn the power-driven roller 46. Another drive motor 28 attached to the pinion of the rack-and-pinion assembly 24 on the base 22 and the cylinder or ram 36 which positions the substantially vertical extendable mast 26 utilize energy provided by a hydraulic fluid power system 80. As shown in FIG. 2A, a set 90 of three valves controls the flow of hydraulic fluid. Pressurized hydraulic fluid passes through a first valve 92 to the hydraulic motor 48 which turns the power-driven roller system 40. The first valve 92 controls the direction and speed of rotation of the power-driven roller 46 on which the section of pipe 110 is supported. The second valve 94 controls the direction and speed of rotation of the hydraulic motor 28 driving the pinion gear which, together with rack on the base, controls the substantially horizontal position of the substantially vertical extendable mast 26. The third valve 96 controls the direction and speed of the hydraulic cylinder or ram 36 mounted either within or alongside the mast 26. The three valves 92, 94, 96 are mounted together on a pedestal 85 which is attached to the hydraulic power unit 80 and to the lifting and translating device 12 by a plurality of hoses 88. The hoses 88 are long enough to enable a wide variety of positions for the pedestal 85 on which the valves 92, 94, 96 are mounted so that the operator can position him/herself in the best location to watch and control the movement of the sections of pipe 110.

Figure 8:
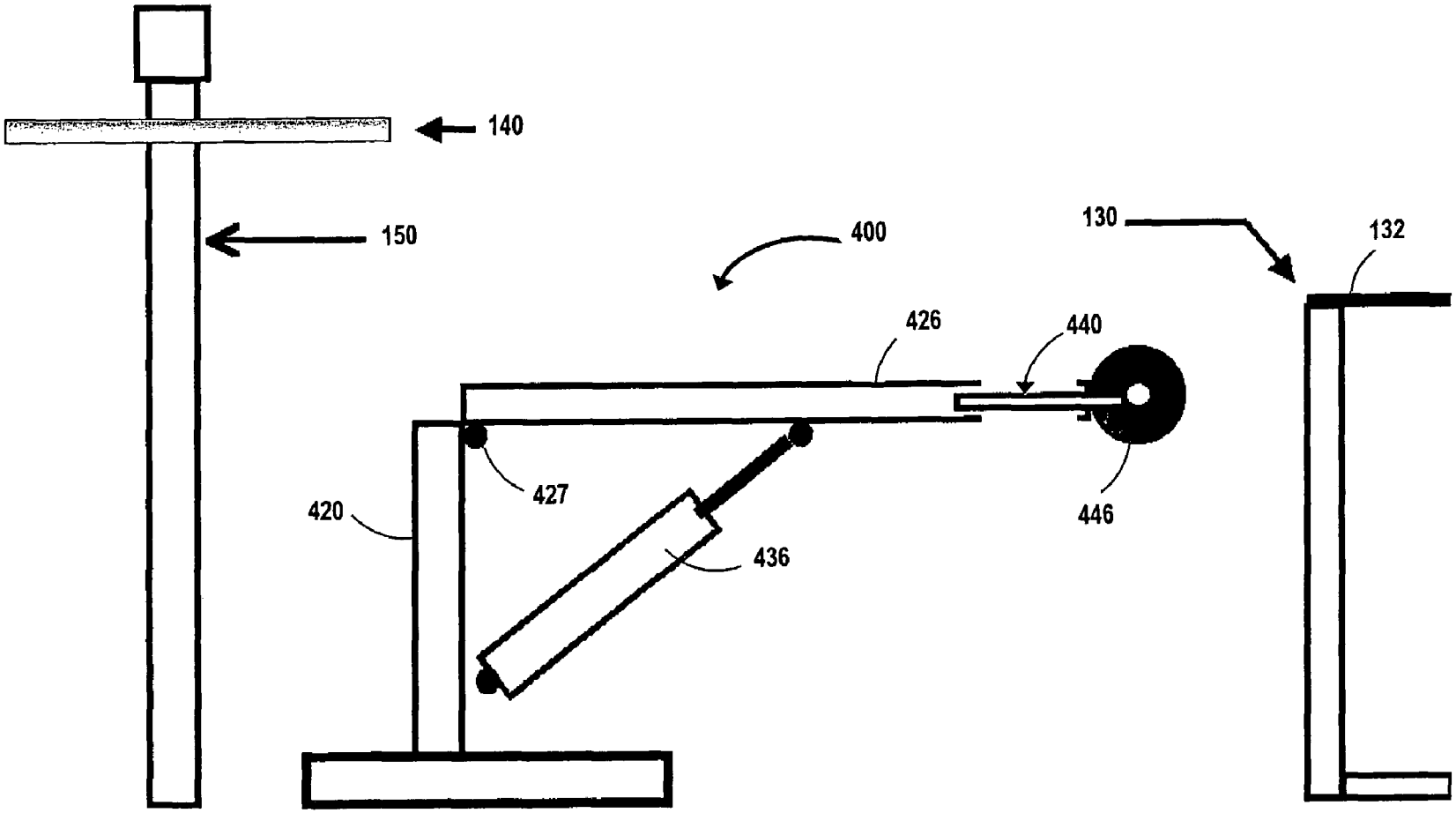
FIG. 8 is a schematic drawing of a first alternate embodiment.

Those of ordinary skill in the art will understand that the present invention is constructed to position the carrier 42 for the power-driven roller assembly 40 in a set of points in an x-axis and a y-axis with respect to an origin in the base portion 22. As shown in FIG. 8 (described below), the carrier 42 may also be positioned in a z-axis which substantially perpendicular to the x-axis and the y-axis.

OPERATION

One of the key features of the present invention is its portability. Unlike the prior art devices for moving a section of pipe, the device of the present invention is light enough and small enough to be loaded in a trailer haulable by a half-ton pickup truck.

Upon arrival at the site of an oil rig, the lifting and translating apparatus 12 is moved to a location where the ends 114 of the sections of pipe 110 are accessible and the destination for the sections of pipe 110 is within the locus of locations serviceable by the relocating system of the present invention 10. Typically, this location is between the rig floor 140 and the end 134 of the catwalk 130 located near the storage racks 120 for the sections of pipe 110 designated for insertion into the well bore 150. Affixing the lifting and translating device 12 to the end 134 of the catwalk 130 is accomplished by using a chain 160 tightened around the base at the bottom of the extendable mast with chain tighteners 162, as shown in FIG. 5.

In actual use it has been found that mounting the hydraulic power unit 80 in the trailer (not shown) used to carry the lifting and translating device 12 and using long hoses 88 to provide hydraulic fluid through the three control valves 92, 94, 96 to the two hydraulic motors 28, 48 and the hydraulic cylinder or ram 36 provides the flexibility to service a broad array of oil rig equipment configurations. Alternatively, the hydraulic power unit 80 may be located at another location than the trailer used to haul the disclosed system 10 to the site of an oil rig. Thus, once the lifting and translating portion 12 of the disclosed system 10 has been positioned and the pedestal 85 on which the valves 92, 94, 96 are mounted has been positioned, the operator connects the hoses 88 and starts a motor (not shown) which energizes the pump on the hydraulic power unit 80. The system 10 is now ready for use.

The end 114 of section of pipe 110 that is to be grabbed by the elevator 160 to be positioned for insertion into the well bore 150 is placed over the end 134 of the catwalk 130. By opening the valve 94 which controls the hydraulic motor 28 attached to the pinion gear the extendable mast 26 is positioned substantially horizontally to a position where the power-driven roller 46 may best contact the end 114 of the section of pipe 110 and to move the section of pipe 110 to where it is needed. The next step is to move the power-driven roller 46 upward by opening the valve 96 which controls the hydraulic cylinder or ram 36 attached to the extendable mast 26 until the power-driven roller 46 contacts the outer surface 112 of the section of pipe 110. The operator is now ready to continue raising the end 114 of the section of pipe 110 as high as needed so that it can be grabbed by equipment 160 being used by well hands working on the rig floor 140. To bring the section of pipe 110 closer to the equipment 160 being used by the well hands working on the rig floor 140, the operator actuates the valve 92 which provides hydraulic fluid to the hydraulic motor 48 attached to the power-driven roller 46. Experienced operators quickly learn how to both lift and translate the section of pipe 110 simultaneously to put the end 114 of the section of pipe 110 in a position accessible to the well hands on the rig floor 140 quickly and repeatedly. In actual practice it has been found that operators of the present invention can move sections of pipe 110 into position faster than the time it takes the well hands to elevate the section of pipe 110 into a vertical position and screw the sections of pipe 110 together.

Disassembly of a string of pipe sections 110 and storage of the individual sections of pipe 110 is done in a manner similar to that described above but in reverse order. Specifically, as the section of pipe 110 is pulled vertically from the well bore 150, it is then swung over to a position near the catwalk 130 where the power-driven roller 46 is moved into a position to enable contact between the power-driven roller 46 and the outside surface 112 of the section of pipe 110. With the surface 44 of the power-driven roller 46 in contact with the outside surface 112 of the section of pipe 110 the section of pipe 110 is both lowered and moved in a line parallel to its long axis where it may be repositioned onto the top surface 132 of the catwalk 130. Alternatively, a guide bar 64 may be attached to the power-driven roller carrier 42 so that the used sections of pipe 110 may be rolled directly onto a storage rack 120 alongside the catwalk 130.

Figure 6:
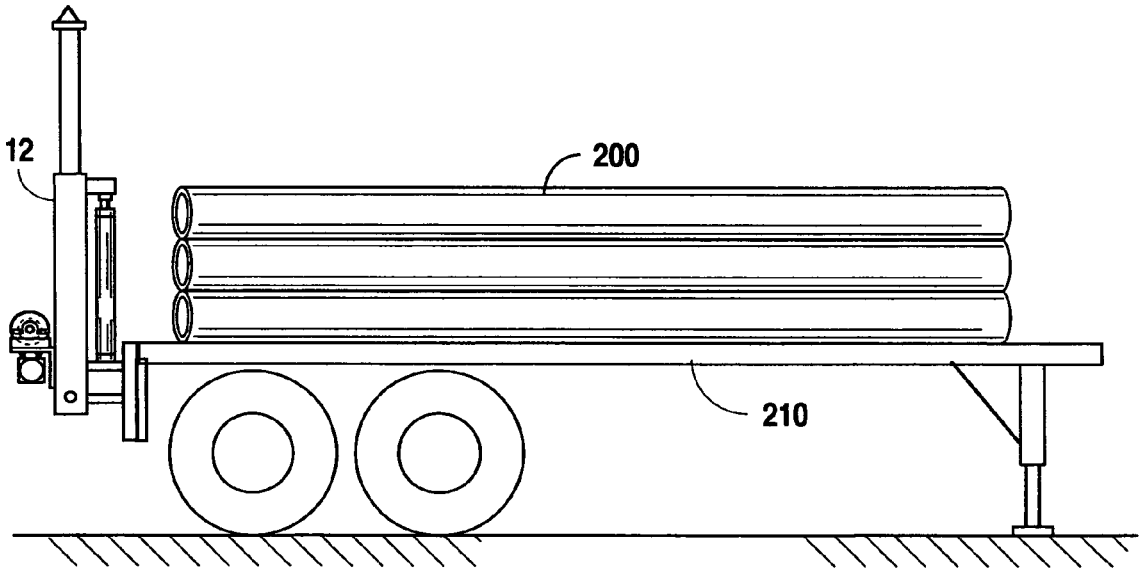
FIG. 6 is an elevational view of the lifting and translating system attached to the end of a semi-trailer.

Those of ordinary skill in the art will realize that while the disclosed invention 10 has been described in terms of its use next to a rig over a well bore 150, there are other applications for the disclosed system 10. For example and as shown in FIG. 6, if extended length objects 200 need to be unloaded from a semi-trailer 210, as shown in FIG. 6, the disclosed system 10 may be used. If sections of pipe or extended length tanks are loaded on a semi-trailer 210 the disclosed system 10 may be used for unloading the pipe or extended length tanks from the semi-trailer 210. Similarly, small bundles of reinforcing bar or extended length steel forms such as channels or angle iron could be offloaded from a semi-trailer 210 using the disclosed system 10 and method.

Figure 7:
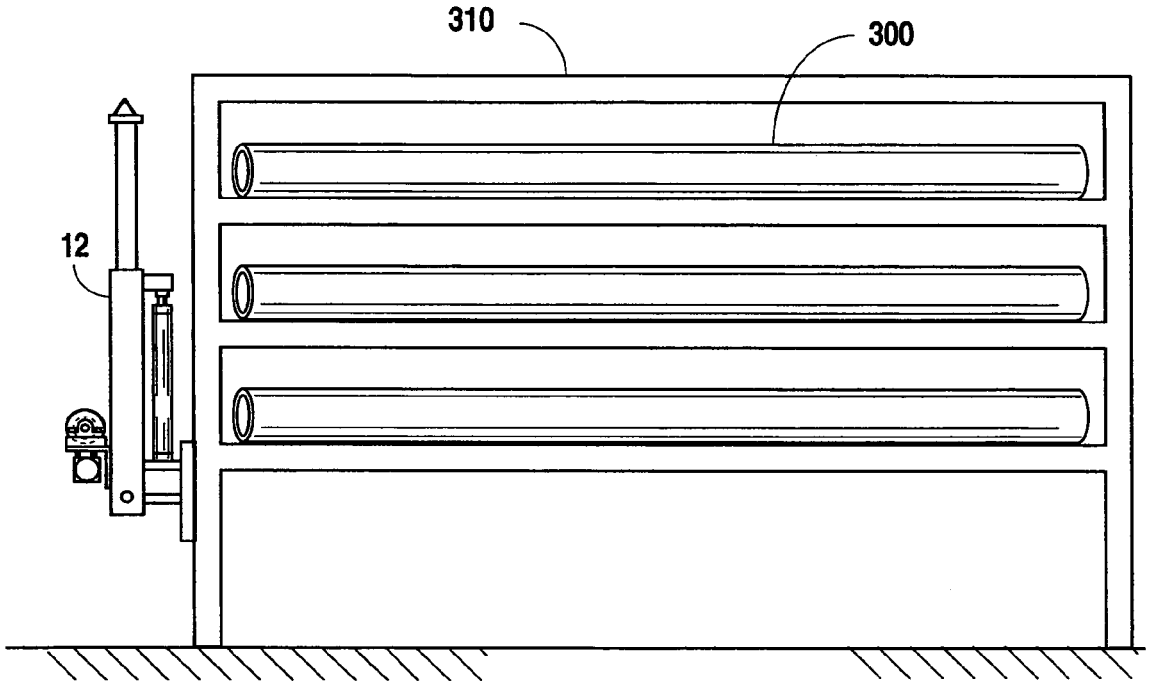
FIG. 7 is an elevational view of the lifting and translating system attached to the end of a storage rack.

In a warehouse setting, as shown in FIG. 7, the disclosed system 10 could be lashed to the end of a storage rack 310 and be used to offload extended length rolls of carpet or plastic sheeting 300. For heavier items, it may be necessary to place a second power-driven roller over the top of the item being moved to place additional frictional force on the item being moved.

In an alternate embodiment 400, shown in FIG. 8, the power-driven roller assembly 440 is mounted to an arm 426 which is pivotably mounted 427 to the base assembly 420. Extension of hydraulic cylinder or ram 436 lifts the power-driven roller assembly 440 through an arcuate path from below the substantially horizontal elevated platform 132 of the catwalk 130 to a position above the substantially horizontal elevated platform 132 of the catwalk 130. The power-driven roller 446 then contacts the end of the section of pipe. Rotation of the power-driven roller 446 translates the section of pipe along a path parallel to the long axis of the section of pipe.

While the disclosed invention has been illustrated by description of its preferred and alternate embodiments, those of ordinary skill in the art will be enabled to find other uses and other constructions to increase its utility. Such other uses and other constructions shall fall within the scope and meaning of the appended claims.

What is claimed is:

1. A device for lifting or lowering one end of a section of substantially horizontally oriented pipe and moving the section of pipe in a direction parallel to the long axis of the section of pipe, said device comprising:

an extendable mast assembly constructed and arranged for positioning near the end of the section of pipe;

a power-driven roller assembly affixed to said extendable mast assembly at a location enabling contact between said power-driven roller and the end of the section of pipe;

whereby movement of said extendable mast assembly causes said power-driven roller to first contact and then change the vertical position of one end of the section of pipe and the turning of said power-driven roller moves the section of pipe in a direction parallel to its long axis.

2. The device as defined in claim 1 wherein said extendable mast assembly includes a base portion.

3. The device as defined in claim 2 wherein said extendable mast assembly includes a mast which is positionable with respect to said base portion.

4. The device as defined in claim 3 wherein said extendable mast assembly includes a hydraulic cylinder for raising said mast.

5. The device as defined in claim 4 wherein said mast is a telescoping mast.

6. The device as defined in claim 5 wherein said hydraulic cylinder is mounted within said telescoping mast.

7. The device as defined in claim 1 wherein said power-driven roller has a substantially V-shaped cross section.

8. The device as defined in claim 1 wherein said power-driven roller is coated with a material selected for its high coefficient of rolling friction with respect to the outer surface of the section of pipe.

9. The device as defined in claim 8 wherein said material is a polyurethane.

10. The device as defined in claim 8 wherein said material has a durometer of approximately 45 to approximately 90.

11. The device as defined in claim 1 further including a hydraulic power supply system for enabling one or more functions selected from a group including: raising or lowering said extendable mast; positioning said extendable mast; and turning said power-driven roller.

12. The device as defined in claim 11 wherein said hydraulic power supply system is locatable at a position remote from said extendable mast assembly.

13. A system for placing sections of pipe in a position where they can be grabbed by an oil or gas production rig for elevation into a substantially vertical orientation for connection with another section of pipe before insertion into a well bore, said system comprising:

a catwalk including a substantially horizontal elevated surface on which one or more sections of pipe are stored;

an extendable mast constructed and arranged for positioning near that portion of said substantially horizontal elevated surface where the ends of the sections of pipe are located;

a powered roller mechanism mounted substantially perpendicular to said extendable mast, said power-driven roller mechanism constructed and arranged to contact the half of the section of pipe nearest the production rig and to both elevate the end of the section of pipe and move the section of pipe along a path parallel to its long axis to a position where it can be grabbed by the oil or gas production rig.

14. The system as defined in claim 13 wherein said extendable mast is mounted to a base portion.

15. The system as defined in claim 14 wherein said base portion is constructed and arranged for mounting to one end of said catwalk.

16. The system as defined in claim 14 wherein said extendable mast is substantially horizontally repositionable with respect to said base portion.

17. The system as defined in claim 13 wherein said extendable mast is extended by connection to one end of an extendable piston and cylinder assembly.

18. The system as defined in claim 13 wherein said extendable mast includes a first section for guiding travel and a second section on which said powered roller mechanism is mounted.

19. The system as defined in claim 13 wherein said powered roller mechanism includes a powered roller on either side of said extendable mast.

20. The system as defined in claim 13 wherein said powered roller mechanism includes at least one grooved roller.

21. The system as defined claim 20 wherein said grooved roller includes a non-metallic coating having a high coefficient of rolling friction.

22. The system as defined in claim 21 wherein said high coefficient of rolling friction enables sliding the non-elevated end of a section of pipe along the substantially horizontal surface of said catwalk.

23. A method for moving an end of a section of pipe from a first substantially horizontal orientation with respect to the long axis of the pipe to a second substantially angular orientation at another location with respect to the long axis of the section of pipe, said method comprising the steps of:

engaging the outer surface of the section of pipe at one end of the section of pipe with a roller;

lifting said roller to move the section of pipe into a substantially angular orientation;

rotating said grooved roller to move the end of the section of pipe to another location along the long axis of the section of pipe.

24. The method as defined in claim 23 wherein said roller is coated with a material that enables movement of the section of pipe along a path parallel to its long axis.

25. The method as defined in claim 23 wherein said roller is mounted on a carrier, said carrier being lifted by the extension of a hydraulic cylinder.

26. The method as defined in claim 25 wherein the bottom of said extendable mast is repositionable in a direction substantially perpendicular to the long axis of the section of pipe.

27. The method as defined in claim 25 wherein said roller is mechanically connected to a source of rotating power.

28. A pipe section repositioning apparatus, said apparatus comprising:

a mounting base defining an x-axis and a y-axis;

an extendable mast extending along said y-axis with respect to said mounting base;

a roller mechanism constructed and arranged to be substantially vertically positioned by said extendable mast;

a drive mechanism for rotating said roller mechanism;

whereby movement of said extendable mast causes said roller mechanism to engage an end of the section of pipe for substantially vertical repositioning of the section of pipe and rotation of said roller mechanism moves the section of pipe in a substantially linear direction.

29. The pipe section repositioning apparatus as defined in claim 28 wherein said mounting base is constructed and arranged for mounting to a planar platform on which the pipe section is stored.

30. The pipe section repositioning apparatus as defined in claim 29 wherein said extendable mast is substantially repositionable along said x-axis.

31. The pipe section repositioning apparatus as defined in claim 28 wherein said roller mechanism is repositionable along said y-axis from a location under said planar platform to a position above said planar platform.

32. The pipe section repositioning apparatus as defined in claim 28 wherein said roller mechanism is constructed and arranged for frictional rolling contact with the outer surface of said pipe section.

33. The pipe section repositioning apparatus as defined in claim 28 wherein said frictional rolling contact with the outer surface of the section of pipe is increased by the use of sand or dirt.

34. A method for moving a section of pipe from a substantially horizontal position on a pipe storage rack to a substantially vertical position over a well bore, said method comprising the steps of:

rolling the section of pipe from the pipe storage rack onto a catwalk having a substantially horizontal elevated platform;

moving a roller into contact with a first end of the section of pipe and then to a position above said substantially horizontal elevated platform portion of said catwalk;

rotating said roller against the outer surface of the section of pipe to translate the position of the section of pipe along said substantially horizontal surface of said catwalk;

continuously lifting and translating the section of pipe with respect to the catwalk;

grabbing said lifted and translated end of the pipe section with an elevator to move the pipe section to a substantially vertical orientation over the well bore.

* * * * *